US006603947B2

(12) United States Patent
Katayanagi et al.

(10) Patent No.: US 6,603,947 B2
(45) Date of Patent: Aug. 5, 2003

(54) FIXING DEVICE HAVING HEAT APPLYING ROTARY BODY AND PRESSURE APPLYING ROTARY BODY, AND IMAGE FORMING APPARATUS EQUIPPED WITH THE FIXING DEVICE

(75) Inventors: Hidetoshi Katayanagi, Hachioji (JP); Hajime Tanaka, Hachioji (JP); Toshiki Hayami, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/000,887

(22) Filed: Nov. 15, 2001

(65) Prior Publication Data

US 2002/0102116 A1 Aug. 1, 2002

(30) Foreign Application Priority Data

Nov. 21, 2000 (JP) ..... 2000-354080

(51) Int. Cl.[7] ..... G03G 15/20
(52) U.S. Cl. ..... 399/333
(58) Field of Search ..... 399/328, 330, 399/331, 333

(56) References Cited

U.S. PATENT DOCUMENTS 4,949,130 A * 8/1990 Torino ..... 399/333 X
5,264,902 A * 11/1993 Suwa et al. ..... 399/333
6,091,926 A * 7/2000 Yamada ..... 399/333 X
6,144,833 A * 11/2000 Ito et al. ..... 399/333 X
6,148,169 A * 11/2000 Tsukamoto ..... 399/333 X
6,219,522 B1 * 4/2001 Ishizuka et al. ..... 399/333
6,377,777 B1 * 4/2002 Kishino et al. ..... 399/333 X
6,400,923 B1 * 6/2002 Fukuda et al. ..... 399/333

* cited by examiner

*Primary Examiner*—Fred L. Braun
(74) *Attorney, Agent, or Firm*—Frishauf, Holtz, Goodman & Chick, P.C.

(57) ABSTRACT

A fixing device for use in an image forming apparatus capable of forming both-side images on a sheet which by using a sheet reversing and conveying device. The fixing device has a heat applying rotary body with an elastic layer made of rubber and a toner releasing layer on top thereof, for coming into contact with and heating a side bearing an unfixed toner image of a transfer sheet; a pressure applying rotary body with an elastic layer made of rubber and a toner releasing layer on top thereof, for fixing and conveying the transfer material by coming into pressure contact and rotating with the heat applying rotary body; and a heat applying source for heating at least one of said rotary bodies. The pressure applying rotary body has a micro-hardness smaller than that of the heat applying rotary body.

16 Claims, 3 Drawing Sheets

FIXING DEVICE HAVING HEAT APPLYING ROTARY BODY AND PRESSURE APPLYING ROTARY BODY, AND IMAGE FORMING APPARATUS EQUIPPED WITH THE FIXING DEVICE

BACKGROUND OF THE INVENTION

This invention relates to a fixing device for use in an image forming apparatus such as a copying machine, a printer, and a FAX machine, and in particular, to a fixing device having a heat applying rotary body such as a heat applying roller and a heat applying fixing belt, and a pressure applying rotary body to be brought in pressing contact with said heat applying rotary body, and an image forming apparatus equipped with said fixing device.

Up to now, for a fixing device which applies heat-fixing processing to a recording material carrying toner particles composed of a resin capable of being fused by heat etc. in an image forming apparatus such as a copying machine, a printer, and a FAX machine, a heat roller method a heat belt method has been mostly employed.

A fixing device of a heat roller type is composed of a heat applying roller which is provided with a heat generation source such as a halogen heater inside and is kept in contact with a surface of a recording material carrying an unfixed toner image, and a pressure applying roller having elasticity to be brought in pressing contact with this, and by letting a recording material such as a paper sheet pass through a fixing nip portion, which is the pressing contact portion of this pair of rollers, it heats and fixes a toner image carried on the recording material.

In a fixing device which is provided in an image forming apparatus of an electrophotographic type to output a color image, a heat applying roller comprising an elastic layer of a silicone rubber or the like on the surface of its metallic roller core is used.

If the heat applying roller is of a hard nature, the surface of the heat applying roller cannot comply with the surface roughness of the toner layer and the paper sheet, and in a half-tone image, the way of toner particle crushing varies with the dot size, which produces a rough appearance of the fixed image and an unevenness of gloss in solid areas, to lower the image quality. In a monochromatic image, similar degradation of image quality occurs, but because monochromatic images have only black color and are mostly centered in a line image or non-glossy image, the above-mentioned defects are comparatively remarkable. For this reason, in order to make color image quality high, a fixing heat roller having an elastic layer is essential.

In a color image forming apparatus equipped with a fixing device of a roller fixing type composed of a heat applying roller having thermally conductive base member (metallic core) covered with an elastic layer thereon and further a releasing layer on it, and a pressure applying roller, for the releasing layer lying on the surface, a fluorine-contained resin, a fluorine-contained rubber, a silicone rubber, etc. are employed. In the case of an image forming apparatus in which images are formed only on one side of paper sheets, it is necessary to select the releasing layer on the surface of the heat applying roller with the following factors taken into consideration; those are image quality, toner offset characteristic, the tendency of a sheet paper to coil round the heat applying roller, durability, etc.

On the other hand, in respect of the releasing layer lying on the surface of the pressure applying roller, only it has been necessary to select its material with attention paid only to durability, toner offset characteristic for preventing toner particles, which have been once offset to the heat applying roller, from transferring to the heat applying roller, and the inclination of a paper sheet to wind itself round the pressure applying roller. In recent years, in a color image forming apparatus capable of duplex copying which has been in process of development, it is necessary to pay attention to the quality of first-side images, and concerning also the releasing layer on the surface of the pressure applying roller, it has now become necessary to select it with attention paid to image quality etc. At present, it is general to make the condition of the releasing layer of the pressure applying roller the same as the releasing layer of the heat applying roller. However, this condition is of no problem as long as unfixed toner images which have been formed on both sides of a transfer material is fixed at a time, but in the case where a toner image which has been formed on the second side of a transfer material is fixed by a fixing device again, after a toner image which has been formed on the first side of the transfer material is once fixed by the fixing device, the first side of the transfer material is to be subjected to fixing process two times, which produces degradation of image quality. Regarding the hardness of the releasing layer, it is found that micro-hardness is specified in the publication of the unexamined patent application 2000-75714; however in this specification, micro-hardness of the surface of a heat applying roller is specified for the purpose of forming a simplex image on an OHP sheet, and it is not related to the solution of the problems in forming duplex copy images as this invention.

Further, a heat applying roller, which is described in the publication of the examined patent application H6-100876 is formed of four layers, which are a roller base member, a silicone rubber layer, a mixture layer composed of a rubber and a resin, and a resin layer, and by a mixture layer as an intermediate layer, the silicone rubber layer lying below and the resin layer lying above are firmly bonded. Because there is neither specification about the thickness and hardness of this heating roller formed of four layers, nor specification about the structure of the pressure applying roller, it does not help to solve the problem in such a case of duplex copy formation as this invention.

Further, in the publications of the unexamined patent application S61-22376, the relation of the thickness values between the releasing layers of the heat applying roller and the pressure applying roller is specified, but the rollers have a structure such that the thickness of the surface releasing layer of the heat applying roller is made smaller than that of the surface releasing layer of the pressure applying roller, which makes worse the compliance of the pressure applying roller surface to the surface roughness of the paper sheet used and the toner layer than that of the heat applying roller; therefore, it does not help to solve the problem in a case of duplex copy formation such as this invention.

SUMMARY OF THE INVENTION

It is an object of this invention to provide a fixing device and an image forming apparatus solving the problems which have been there up to now as described in the above.

The above-mentioned object is accomplished by any one of the structures described below.

Structure 1: A fixing device for use in an image forming apparatus capable of making a duplex copy by a paper sheet inverting conveyance means comprising a heat applying rotary body having at least one elastic rubber layer or more and a toner releasing layer on the surface for heating by contact the one side of a transfer material carrying an unfixed toner image, a pressure applying roller having at least one elastic rubber layer or more and a toner releasing layer on the surface for conveying a transfer material for fixing as kept in rotary contact with the heat applying rotary body, a drive source for driving at least one of said rotary bodies, and a heat applying source for heating at least one of said rotary bodies, characterized in that the micro-hardness of the surface of said pressure applying rotary body is made smaller than the micro-hardness of the surface of said heat applying rotary body.

Structure 2: A fixing device as set forth in structure 1 characterized in that the micro-hardness of the surface of the aforesaid pressure applying rotary body in the state where the both of the aforesaid heat applying rotary body and said pressure applying rotary body are not provided with a surface layer is not smaller than the micro-hardness of the surface of said heat applying rotary body.

Structure 3: A fixing device as set forth in structure 1, characterized in that the value of the aforesaid micro-hardness is a value in the case where the elastic rubber layers of the aforesaid heat applying rotary body and the aforesaid pressure applying rotary body are formed of the same material to have the same thickness.

Structure 4: A fixing device as set forth in any one of structures 1 to 3, characterized in that the releasing layer of the aforesaid heat applying rotary body and that of the aforesaid pressure applying rotary body are formed of the same material, and the thickness of the releasing layer of said pressure applying rotary body is made smaller than the thickness of the releasing layer of said heat applying rotary body.

Structure 5: A fixing device as set forth in any one of structures 1 to 3, characterized in that the hardness of the releasing layer of the aforesaid pressure applying rotary body is made smaller than the hardness of the releasing layer of the aforesaid heat applying rotary body.

Structure 6: A fixing device as set forth in any one of structures 1 to 3, characterized in that the aforesaid heat applying rotary body and the aforesaid pressure applying rotary body have at least one or more mixture layers composed of rubber and resin between the elastic rubber layer and the releasing layer, and in the case where the releasing layers are formed of the same material to have the same thickness, the thickness of the mixture layer of said pressure applying rotary body is made smaller than the thickness of the mixture layer of said heat applying rotary body.

Structure 7: A fixing device as set forth in any one of structures 1 to 3, characterized in that the aforesaid heat applying rotary body and the aforesaid pressure applying rotary body have at least one or more mixture layers composed of rubber and resin between the elastic rubber layer and the releasing layer, and in the case where the releasing layers are formed of the same material to have the same thickness, the hardness of the mixture layer of said pressure applying rotary body is made smaller than the hardness of the mixture layer of said heat applying rotary body.

Structure 8: A fixing device as set forth in any one of structures 1 to 7, characterized in that both of the aforesaid heat applying rotary body and the aforesaid pressure applying rotary body have a shape of a roll having a stiff base member inside the elastic layer.

Structure 9: A fixing device as set forth in structure 8, characterized in that the Asker-C hardness of the aforesaid pressure applying rotary body is made larger than the Asker-C hardness of the aforesaid heat applying rotary body.

Structure 10: A fixing device as set forth in structure 8, characterized in that the elastic layer of the aforesaid pressure applying rotary body and the elastic layer of the aforesaid heat applying rotary body are formed to have the same Asker-C hardness per unit thickness, and the thickness of the elastic layer of said heat applying rotary body is made larger than the thickness of the elastic layer of said pressure applying rotary body.

Structure 11: A fixing device as set forth in structure 8, characterized in that the elastic layer of the aforesaid pressure applying rotary body and the elastic layer of the aforesaid heat applying rotary body are formed to have the same thickness, and Asker-C hardness of the elastic layer of said heat applying rotary body is made smaller than the Asker-C hardness of the elastic layer of said pressure applying rotary body.

Structure 12: A fixing device as set forth in any one of structures 1 to 7, characterized in that the aforesaid heat applying rotary body is a heat applying fixing belt having a shape of an endless belt, and the two aforesaid pressure applying rotary bodies both have a shape of a roll comprising a stiff base member inside the elastic layer.

Structure 13: A fixing device as set forth in structure 12, characterized in that said fixing device further comprises a heat applying fixing belt pressing body kept in contact with the inner side of the aforesaid heat applying fixing body for pressing the heat applying fixing belt to the aforesaid pressure applying rotary body.

Structure 14: A fixing device as set forth in structure 13, characterized in that the Asker-C hardness of the aforesaid pressure applying rotary body is made larger than the Asker-C hardness of the aforesaid heat applying fixing belt pressing body.

Structure 15: An image forming apparatus equipped with a fixing device as set forth in any one of structures 1 to 14, characterized in that said image forming apparatus comprises an image forming means capable of outputting an image having at least two or more colors.

Structure 16: An image forming apparatus as set forth in any one of structures 1 to 15, characterized in that the surface layer of the aforesaid heat applying rotary body and the aforesaid pressure applying rotary body is mainly composed of PFA, the toner for use in said apparatus includes a wax, and the fixing device has no mechanism for coating the surface of the heat applying rotary body and the surface of the pressure applying rotary body with a releasing agent.

Further, preferable structures are as follows:

(1) A fixing device comprising a heat applying rotary body having a thermally conductive base member coated with an elastic layer and further a releasing layer thereon, a pressure applying rotary body having a thermally conductive base member coated with an elastic layer and further a releasing layer thereon to be brought in pressing contact with said heat applying rotary body, and a drive source for driving at least one of said rotary bodies, characterized in that the releasing layer of said heat applying rotary body and the releasing layer of said pressure applying rotary body are formed of the same material, and the thickness of the releasing layer of said pressure applying rotary body is smaller than the thickness of the releasing layer of said heat applying rotary body.

(2) A fixing device comprising a heat applying rotary body having a thermally conductive base member coated with an elastic layer and further a releasing layer thereon, a pressure applying rotary body having a thermally conductive base member coated with an elastic layer and further a releasing layer thereon to be brought in pressing contact with said heat applying rotary body, and a drive source for driving at least one of said rotary bodies, characterized in that the micro-hardness of said pressure applying rotary body is made smaller than the micro-hardness of said heat applying rotary body.

(3) A fixing device comprising a heat applying rotary body having a thermally conductive base member coated with an elastic layer and further a releasing layer thereon, a pressure applying rotary body having a thermally conductive base member coated with an elastic layer and further a releasing layer thereon to be brought in pressing contact with said heat applying rotary body, and a drive source for driving at least one of said rotary bodies, characterized in that the hardness of the releasing layer of said pressure applying rotary body is made smaller than the hardness of the releasing layer of said heat applying rotary body.

(4) A fixing device comprising a heat applying rotary body, which has a thermally conductive base member coated with an elastic layer, further a mixture layer composed of a rubber and a resin thereon, and further a resin layer thereon, and is heated by a heat applying source, a pressure applying rotary body, which has a thermally conductive base member coated with an elastic layer, further a mixture layer composed of a rubber and a resin, and further a resin layer thereon, and is brought in pressing contact with said heat applying rotary body, and a drive source for driving at least one of said rotary bodies, characterized in that the resin layer of said heat applying rotary body and the resin layer of said pressure applying rotary body are formed of the same material, the resin layer of said heat applying rotary body and the resin layer of said pressure applying rotary body are formed to have the same thickness, and the thickness of the mixture layer of said pressure applying rotary body is made smaller than the thickness of the mixture layer of said heat applying rotary body.

(5) A fixing device comprising a heat applying rotary body, which has a thermally conductive base member coated with an elastic layer, further a mixture layer composed of a rubber and a resin thereon, and further a resin layer thereon, and is heated by a heat applying source, a pressure applying rotary body, which has a thermally conductive base member coated with an elastic layer, further a mixture layer composed of a rubber and a resin, and further a resin layer thereon, and is brought in pressing contact with said heat applying rotary body, and a drive source for driving at least one of said rotary bodies, characterized in that the micro-hardness of said pressure applying rotary body is made smaller than the micro-hardness of said heat applying rotary body.

(6) A fixing device comprising a heat applying rotary body, which has a thermally conductive base member coated with an elastic layer, further a mixture layer composed of a rubber and a resin thereon, and further a resin layer thereon, and is heated by a heat applying source, a pressure applying rotary body, which has a thermally conductive base member coated with an elastic layer, further a mixture layer composed of a rubber and a resin, and further a resin layer thereon, and is brought in pressing contact with said heat applying rotary body, and a drive source for driving at least one of said rotary bodies, characterized in that the resin layer of said heat applying rotary body and the resin layer of said pressure applying rotary body are formed of the same material, the resin layer of said heat applying rotary body and the resin layer of said pressure applying rotary body are formed to have the same thickness, and the hardness of the mixture layer of said pressure applying rotary body is made smaller than the hardness of the mixture layer of said heat applying rotary body.

(7) An image forming apparatus characterized in that it is equipped with a fixing device as set forth in any one of the above-mentioned structures (1) to (6), means for forming an image, and means for conveying a paper sheet.

DETAILED DESCRIPTION OF THE PREFERRED EMBODIMENT

Figure 1:
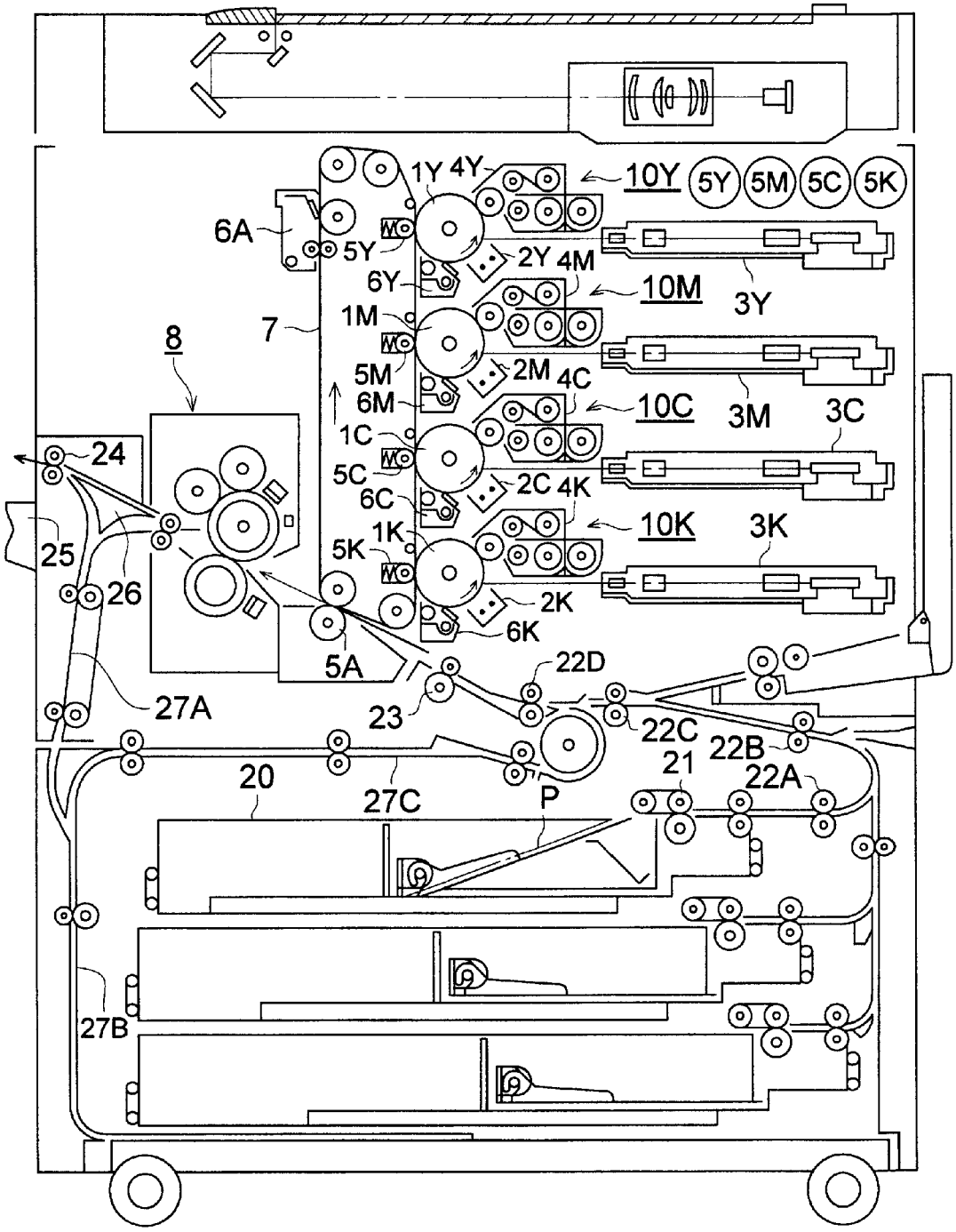
FIG. 1 is a cross-sectional view of the structure of a color image forming apparatus showing an example of the embodiment of an image forming apparatus equipped with a fixing device according to this invention.

In the following, the embodiment of a fixing device and an image forming apparatus of this invention will be explained by referring to the drawings.

(An Embodiment of an Image Forming Apparatus)

FIG. 1 is a cross-sectional view of a color image forming apparatus showing an example of the embodiment of an image forming apparatus equipped with a fixing device according to this invention.

This color image forming apparatus is one that is called a tandem-type color image forming apparatus, and consists of a plurality of sets of image forming parts 10Y, 10M, 10C, and 10K which are arranged in a vertical row, a semi-conductive endless-belt-shaped intermediate transfer member 7 which is entrained around a plurality of rollers and is supported rotatably, means for feeding and conveying a paper sheet, and a fixing device 8.

The image forming part 10Y for forming an image of yellow comprises a charging means 2Y, an exposure means 3Y, a developing means 4Y, a primary transfer means 5Y, and a cleaning means 6Y, all of which are arranged around the circumference of an image carrying body (a photoreceptor) 1Y. The image forming part 10M for forming an image of magenta comprises an image carrying body (a photoreceptor) 1M, a charging means 2M, an exposure means 3M, a developing means 4M, a primary transfer means 5M, and a cleaning means 6M. The image forming part 10C for forming an image of cyan comprises an image carrying body (a photoreceptor) 1C, a charging means 2C, an exposure means 3C, a developing means 4C, a primary transfer means 5C, and a cleaning means 6C. The image forming part 10K for forming an image of black comprises an image carrying body (a photoreceptor) 1K, a charging means 2K, an exposure means 3K, a developing means 4K, a primary transfer means 5K, and a cleaning means 6K.

Images of the respective colors formed by the image forming parts 10Y, 10M, 10C, and 10K respectively are successively transferred to a revolving intermediate transfer member 7 by the primary transfer means 5Y, 5M, 5*c*, and 5K respectively, to form a composite color image. A transfer material (hereinafter referred to as a paper sheet too) P contained in a paper feed cassette 20 is fed by a paper feeding means 21, is conveyed to a secondary transfer means 5A through a plurality of intermediate rollers 22A, 22B, 22C, and 22D, and a registration roller 23, and plural toner images composing the color image are transferred all at a time onto the paper sheet P. The paper sheet P having the color image transferred thereon is subjected to fixing processing by the fixing device 8, is gripped between a pair of rollers 24, and is placed on an output tray 25 outside the machine.

At the time of duplex copy formation, a paper sheet P which has an image formed on its first side and has been ejected from the fixing device 8 is deviated from the sheet ejection path by a bifurcating means 26, passes the below-positioned paper inverting paths 27A, 27B, and 27C, and comes back to the intermediate roller pair 22D. The paper sheet P, which has passed the conveyance path for inverting, is conveyed to the secondary transfer means 5A through the registration roller 23, and toner images composing a color image are transferred onto the second surface of the paper sheet P all at a time. The paper sheet P, which has a color image transferred thereon, is subjected to fixing processing by the fixing device 8, is gripped between the paper ejection rollers 24, and is placed on the output tray 25 outside the machine.

On the other hand, the intermediate transfer member 7, which has detached the paper sheet P by utilizing the curvature after the color image was transferred to the paper sheet P by the secondary transfer means 5A, has its residual toner particles removed by the cleaning means 6A.

Throughout image formation processing, the primary transfer means 5K is kept in pressing contact with the photoreceptor 1K. Other primary transfer means 5Y, 5M, and 5C are brought in pressing contact with the photoreceptors 1Y, 1M, and 1C corresponding to them respectively only during the pertinent color image formation. The secondary transfer means 5A is brought in pressing contact with the intermediate transfer member 7 only while a paper sheet P passes here to be subjected to secondary transfer process.

(Overall Structure of a Fixing Device)

Figure 2:
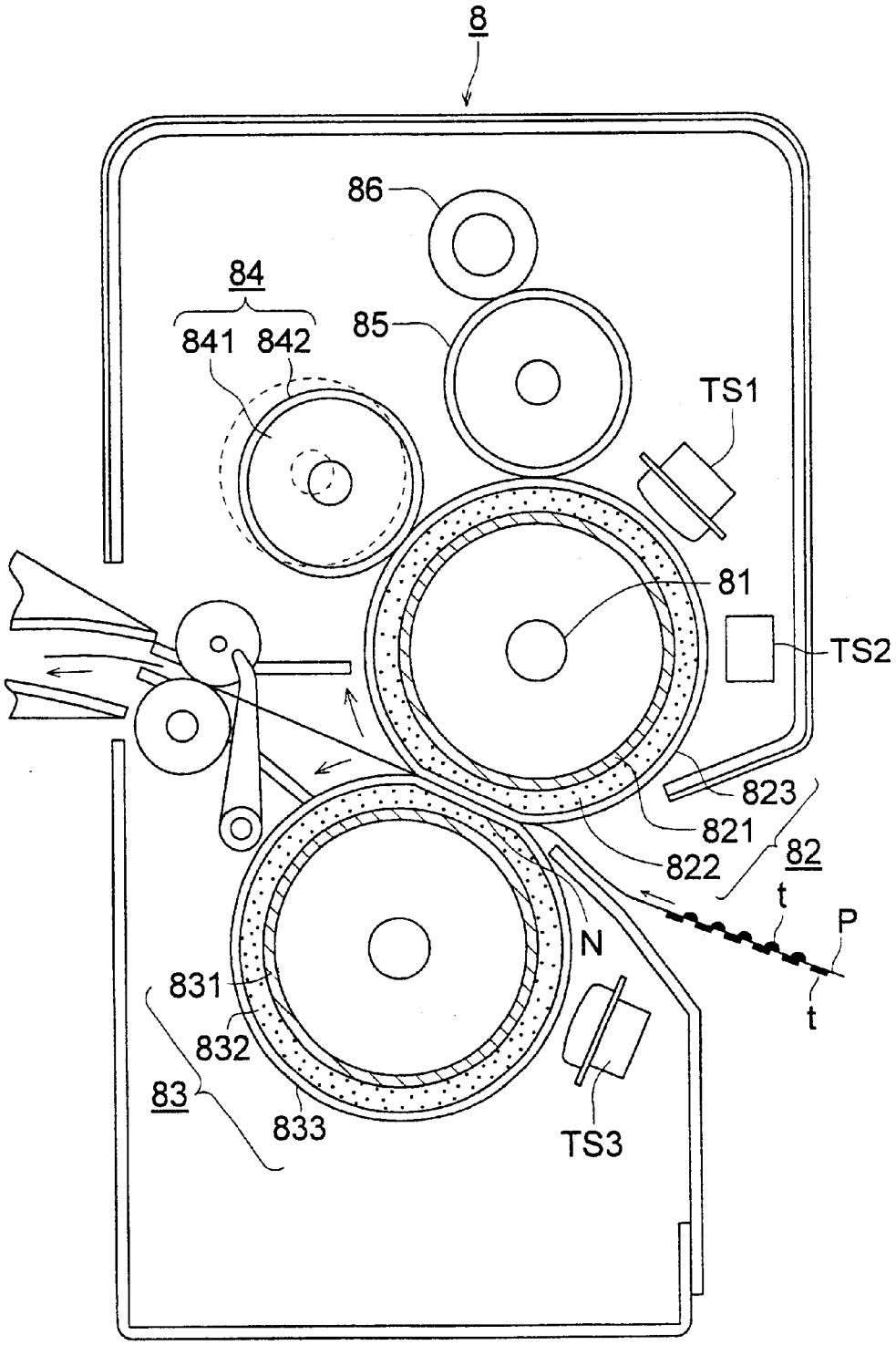
FIG. 2 is a cross-sectional view showing an example of the embodiment of a fixing device of this invention.

FIG. 2 is a cross-sectional view showing an example of the embodiment of a fixing device of this invention.

The fixing device (roller fixing device) 8 is composed of a heat applying source 81, a heat applying roller (heat applying rotary body) 82, a pressure applying roller (pressure applying rotary body) 83, etc. Around the circumference of the heat applying roller 82, a cleaning roller 84, an oil coating roller 85, and a temperature sensor of a non-contact type TS2 are arranged. If the releasing layer of the heat applying roller is composed of a fluorine-contained resin such as PFA, and the toner includes a wax by an enough amount to have a sufficient releasing capability against the surface of the heat applying roller 82, the cleaning roller 84 and the oil coating roller 85 become unnecessary.

For the heat applying source 81, a halogen lamp, an induction heating means, etc. can be used. The heat applying roller 82 is composed of a thermally conductive base member (metallic core) 821, an elastic layer 822 made of a silicone rubber or the like covering the outer side of the thermally conductive base member 821, a releasing layer 823 composed of a fluorine-contained resin covering its further outer side, etc.

The pressure applying roller 83 is composed of a thermally conductive base member (metallic core) 831, an elastic layer 832 made of a silicone rubber or the like lying on the circumference of the base member, and a releasing layer 833 made of a fluorine-contained resin covering its further outer side. N denotes the fixing nip portion where the pressure applying roller 83 and the heat applying roller 82 are kept in pressing contact with each other.

The temperature sensor TS2 detects the surface temperature of the heat applying roller 82. By a detection signal of the temperature sensor TS2, a control means (not shown in the drawing) controls the current flow to the heat applying source 81, to control the surface temperature of the heat applying roller 82 at a specified temperature. In some cases, a heat applying source such as a halogen lamp is also provided inside the metallic core 831 of the pressure applying roller 83, a temperature sensor is also provided in a non-contact manner at the surface of the pressure applying roller, and the electric current flow to the heat applying source of the pressure applying roller is controlled by the detection signal from the temperature sensor.

When a paper sheet P is introduced into the fixing nip portion N where the heat applying roller 82 and the pressure applying roller 83 are kept in pressing contact with each other, heat of the heat applying roller which has been heated by the heat applying source 81 is given to the paper sheet P, and the unfixed toner image t on the paper sheet P is heated and fixed.

(Heat Applying Roller)

The heat applying roller 82 is a cylindrical body having a diameter of 20 to 70 mm composed of the thermally conductive base member 821, the elastic layer 822, and the releasing layer 823. For the cylindrical thermally conductive base member 821, an aluminum material having a good thermal conductivity (A5056, A5052, A5083, A6063, etc.) can be mostly used, and also a non-magnetic stainless steel material (STKM11, etc.) can be used. The thermally conductive base member 821 has a required mechanical strength, and is a cylindrical body having a thickness of 0.8 to 5 mm.

The elastic layer 822 is formed of a rubber such as a silicone rubber or a fluorine-contained rubber, for example. Further, in order to cope with the requirement for making image formation speed high, it is preferable a method in which thermal conductivity is improved by adding 5 to 30% by weight of metallic powders such as silica, alumina, and magnesium oxide as a filler in the above-mentioned synthetic rubber, and one that is formed of an elastic layer having a thermal conductivity of $(2 \text{ to } 20)\times10^{-3}$ J/cm·s·K is used. If a conductive carbon black material is used for the filler, the electric resistance (volume resistivity) of the elastic layer 822 can be easily set at a low value, which is effective for preventing the static electrification of the heat applying roller 82. The thickness of the elastic layer 822 is 0.5 to 5 mm, or desirably, 1 to 3 mm. In addition, a thin adhesive-bonding layer is provided between the thermally conductive base member 821 and the elastic layer 822.

In order to make better the releasing capability against the toner, on the outer side (outer circumferential surface) of the elastic layer, the releasing layer 823 is provided as a layer composed of a covering tube made of PFA (fluorine-contained resin) having a thickness of 15 to 70 $\mu$m, or a layer composed of a paint of fluorine-contained resin (PFA, PTFE, or a mixture of PFA and PTFE) coated to a thickness of 15 to 70 $\mu$m. The releasing layer 823 makes the releasing capability against the toner better, and also the durability of the elastic layer can be raised. If the toner to be used includes a wax by an amount enough to give the toner sufficient releasing capability against the surface of the heat applying roller 82, the cleaning roller 84 and the oil coating roller 85 become unnecessary. On the premise that the cleaning roller 84 and the oil coating roller 85 are provided, it may be allowed to provide a fluorine-contained rubber layer on the outer side of the elastic layer 822, or to provide a fluorine-contained latex rubber layer and a silicone rubber layer of high releasing capability further on it. Besides, a thin adhesive-bonding layer is provided between the elastic layer 822 and the releasing layer 823.

(Another Embodiment of a Heat Applying Roller)

Figure 3:
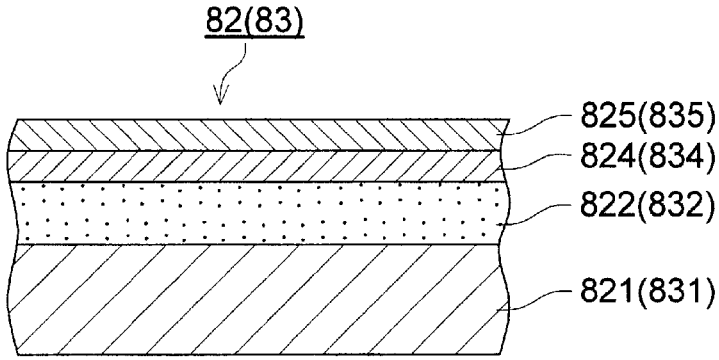
FIG. 3 is a drawing of a layer structure showing another example of the embodiment of a heat applying roller and a pressure applying roller.

FIG. 3 is a drawing of a layer structure showing another example of the embodiment of the heat applying roller 82 and the pressure applying roller 83. In addition, in respect of the signs used in FIG. 3, the same ones are attached to the parts having the same function as those in FIG. 2. Besides, only the points which are different from FIG. 2 will be explained.

The heat applying roller 82 is composed of four layers, which are a thermally conductive base member 821, an elastic layer 822 covering it, a mixture layer 824 composed of a rubber and a resin further on it, and a resin layer 825 further on it. Thin adhesive-bonding layers are provided between the thermally conductive base member 821 and the elastic layer 822, and between the elastic layer 822 and the mixture layer 824, respectively.

The thermally conductive base member 821 and the elastic layer 822 have the same structure as the above-mentioned ones respectively. The resin layer 825 at the outermost part is formed of a fluorine-contained resin such as perfluoro-alkoxy resin (PFA) for example, and is a thin layer having a thickness of several tens $\mu$m. The mixture layer 824 is formed as a bonding layer for the elastic layer 822 and the resin layer 825, and at the same time, it acts as a buffer material between the resin layer 825 and the elastic layer 822, when the heating roller 82 is rotated as kept in pressing contact with the pressure applying roller 83, to prevent the generation of a crack in the resin layer 825.

The mixture layer 824 lying under the resin layer 825 is formed of a mixture of a fluorine-contained resin and a fluorine-contained resin, and is a thin layer having a thickness of several tens $\mu$m. The mixture layer 824 is formed as a bonding layer for the elastic layer 822 and the resin layer 825, and while the heat applying roller 82 is rotating in pressing contact with the pressure applying roller 83, it also functions as a buffer material between the resin layer 825 and the elastic layer 822, to prevent the generation of a crack in the resin layer 825. In the case where the elastic layer 822 is a silicone rubber layer, also it is appropriate to provide a thin layer composed of a fluorine-contained rubber between the elastic layer 822 and the mixture layer 824 in order to enhance the bonding capability and the buffer function.

(Pressure Applying Roller—Referring to FIG. 2)

The pressure applying roller 83, which is a cylindrical fixing member at the lower side to make a pair with the heating roller 82 at the upper side, is composed of the thermally conductive base member 831, the elastic layer 832, and the releasing layer 833. The members composing the pressure applying roller 83 are formed of approximately the same material to have approximately the same characteristic and size as the composing members of the heating roller 82, respectively.

For example, it has a structure as a soft roller having an outer diameter of 20 to 70 mm formed of the thermally conductive base member 831 made of an aluminum material, and the elastic layer 832 composed of a rubber layer having a thickness of 0.5 mm to 5 mm made of a silicone rubber, or a fluorine-contained rubber. On the outer side (outer circumferential surface) of the elastic layer 832, the releasing layer 833 is formed of a coating of a heat resistant fluorine-contained resin such as PFA or PTFE having releasing capability. Between the heat applying roller 82 at the upper side which is supported rotatably at a fixed position and the pressure applying roller 83 at the lower side which is spring-urged to be kept in pressure contact with the heat applying roller 82, the fixing nip portion N is formed, and fixing of a toner image t can be performed.

As an another example of the embodiment of the pressure applying roller 83, in the same way as the layer structure of the heating roller shown in FIG. 3, the pressure applying roller 83 is formed of four layers, which are a thermally conductive base member 831 covered with an elastic layer 832, a mixture layer 834 composed of a rubber and a resin on it, and a resin layer (releasing layer) 835 laminated further on it.

(Another Embodiment of a Fixing Device)

Figure 4:
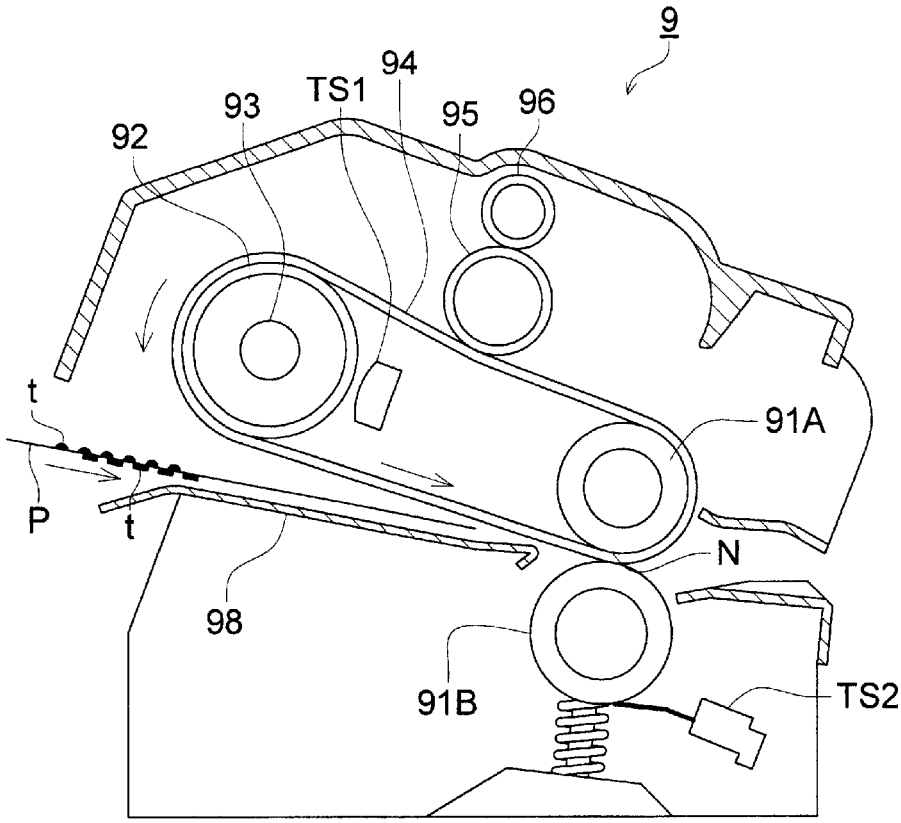
FIG. 4 is a cross-sectional view showing another example of the embodiment of a fixing device.

FIG. 4 is a cross-sectional view showing another example of the embodiment of a fixing device.

The fixing device 9 is composed of a heat applying source 93, a rotatable heat applying roller 92, a pair of an upper pressure applying roller 91A and a lower pressure applying roller 91B which are rotatable in pressing contact with each other, a heat applying fixing belt 94 (heat applying rotary body) which are capable of revolving, wound round the respective outer circumferential surfaces of the upper pressure applying roller 91A and the lower pressure applying roller 91B, etc.

The fixing device 9 makes the heat applying fixing belt 94 heated by the heat applying roller 92 revolve, makes the pair of rotary pressure applying rollers 91A and 91B grip a paper sheet P between them to convey it, and heats and fixes the toner image t on a paper sheet P.

Above the heat applying fixing belt 94, an oil coating roller 95 for coating the heat applying fixing belt 94 with an oil, and a cleaning roller 96 for cleaning the surface of the oil coating roller 95 are disposed. If the releasing layer of the heat applying fixing belt is composed of a fluorine-contained resin such as PFA, and the toner to be used includes a wax by an amount enough to give the toner sufficient releasing capability against the surface of the heat applying fixing belt 94, the cleaning roller 96 and the oil coating roller 95 become unnecessary.

The upper pressure applying roller 91A is formed of a foamed elastic member with a low hardness. The lower pressure applying roller 91B has a surface layer made of a rubber covered with a fluorine-contained resin such as PFA. The heat applying roller 92 is a roller having a fluorine-contained resin layer formed on a thermally conductive base member made of an aluminum material, for example, and has a heat applying source 93 inside. The heat applying fixing belt 94 is an endless belt, has a structure similar to the layer structure of the heat applying roller 82 shown in FIG. 2 and FIG. 3, and is capable of elastic deformation. That is, it has a three-layer structure composed of an electro-formed nickel layer or a heat resistant resin layer such as a polyimide layer as the thermally conductive base member covered with an elastic layer 822 and further a releasing layer 823, or a four-layer structure composed of a thermally conductive base member 821, an elastic layer 822, a mixture layer 824, and a resin layer 825. Thin adhesive-bonding layers are provided respectively between the base member consisting of a electro-formed nickel or polyimide and the elastic layer 822, and between the elastic layer and the mixture layer 824. It is also appropriate to make a five-layer structure by providing a thin layer composed of a fluorine-contained resin between the elastic layer 822 and the mixture layer 824 in the four-layer structure in order to enhance the bonding ability and the buffer function.

In the neighborhood of the outer circumferential surface of the heat applying roller 92, a temperature sensor TS1 is disposed, and in the neighborhood of the outer circumferential surface of the lower pressure applying roller 91B, a temperature sensor TS2 is disposed.

A guide plate 98 is disposed under the heat applying fixing belt 94. A paper sheet P, which is conveyed to the fixing device 9 by a conveyance means (not shown in the drawing), passes through the tilted clearance between the guide plate 98 and the heat applying fixing belt 94, and is fed into the fixing nip portion N where the upper pressure applying roller 91A and the lower pressure applying roller 91B are kept in pressing contact with each other. In the case of the structure shown in FIG. 4, it sometimes occurs that a paper sheet P and the heat applying fixing belt are brought into contact with each other by the curl of the paper sheet P at the time of fixing the second side of the sheet, and in that case, a countermeasure to place the heat applying roller 92 at the upper side of the upper pressure applying roller 91A is sometimes taken.

A toner image, which has been formed on the paper sheet P, is heated and fused by the heat applying fixing belt 94, which is heated by the heat applying roller 92 heated by the heat applying source 94 and is made to revolve by a drive means (not shown in the drawing), and at the same time, it is pressed by the upper pressure applying roller 91A and the lower pressure applying roller 91B to be fixed to the paper sheet P.

(An Embodiment of the Heat Applying Roller 82 and the Pressure Applying Roller 83)

Concerning the image degradation in the fixing process, it has been found that the softer the surface layer in contact with the unfixed image surface is, the more easily the surface layer complies with the roughness of the paper sheet P, the presence or absence of the toner particles, and the thickness of the toner layer, which makes image degradation such as uneven toner fusing smaller. Therefore, by employing any one of the structures described in structures 1 to 7, to make the surface of the releasing layer 833 of the pressure applying roller 83 more easily comply with the surface of a transfer material P carrying a toner image t as compared to the releasing layer 823 of the heat applying roller 82, it is possible to suppress the image degradation owing to it that the first side of the transfer material P is brought into contact with the heat applying roller 82 and the pressure applying roller 83 once for each, to a degree not so remarkable as compared to the degradation of the second toner image t on the transfer material P. Further, by employing any one of the conditions described in structures 9 to 11, and 14, the shape of the fixing nip portion N in the case where the fixing device is seen from the lateral side becomes convex-shaped toward the direction of the heat applying roller 82, which makes it possible to enhance the separation capability of the transfer material P against the heat applying roller 82, and the detaching capability, the gloss of the image surface, and the level of the image degradation can be stabilized.

In the examples 1 to 5 shown in Table 1 to Table 5 described below, the difference in image quality between the first side and the second side of a transfer material P is improved as compared to the comparative examples 1 to 5.

The values of rubber hardness H1 of the heat applying roller and the pressure applying roller shown in Table 1 to Table 5 are obtained by measurement using a rubber hardness meter. For the rubber hardness meter, ones of various types are standardized and commercialized.

For a hardness meter to measure the hardness of a hard rubber, a sponge, a foamed elastomer, etc., Asker-C type specified in the Japan society of rubber industry standard (SRIS) is suitable.

The surface hardness of the releasing layer was measured by a micro-hardness meter model MD-1 (manufactured by High-molecular Instrument Co., Ltd.). A micro-hardness meter is suitable for measuring the hardness of a thin object having a thickness not greater than 2 mm such as a rubber material, a thermoplastic elastomer, and a soft plastics material.

In a Shore D hardness meter H2, hardness is defined by the height of rebounding when a hammer with a specified mass and shape with a diamond tip buried in its front end is caused to drop freely from a position of a specified height. For example, the Shore hardness can be measured by a rubber-plastic hardness meter model Asker-D (manufactured by High-molecular Instrument Co., Ltd.).

The hardness of the mixture layer was measured on the basis of JIS-A hardness (JIS-K6253, JIS-K7215, ISO-7619).

TABLE 1

| | Outer diameter of roller product (mm) | Outer diameter of A5056 metallic core (mm) | Thickness of silicone rubber elastic layer (mm) | Hardness of rubber material (Asker-C) | Material of releasing layer | Thickness of releasing layer (mm) | Micro hardness of roller | Micro hardness of roller when only silicone rubber is coated |
|---|---|---|---|---|---|---|---|---|
| Example 1 | | | | | | | | |
| Heat applying roller | 50 | 46 | 2 | 30 | PFA | 0.04 | 77 | 20 |
| Pressure applying roller | 50 | 48 | 1 | 30 | PFA | 0.02 | 65 | 20 |
| Comparative example 1 | | | | | | | | |
| Heat applying roller | 50 | 46 | 2 | 30 | PFA | 0.04 | 77 | 20 |

TABLE 1-continued

| | Outer diameter of roller product (mm) | Outer diameter of A5056 metallic core (mm) | Thickness of silicone rubber elastic layer (mm) | Hardness of rubber material (Asker-C) | Material of releasing layer | Thickness of releasing layer (mm) | Micro hardness of roller | Micro hardness of roller when only silicone rubber is coated |
|---|---|---|---|---|---|---|---|---|
| Pressure applying roller | 50 | 48 | 1 | 30 | PFA | 0.04 | 70 | 20 |

All of silicone material and releasing layer material are the same, respectively As shown in FIG. 2, the heat applying roller 82 and the pressure applying roller 83, which are shown in the example 1 and comparative example 1 in Table 1, have the three-layer structures respectively formed of the thermally conductive base members 821 and 831 composed of the A5056 material, the elastic layers 822 and 833 composed of a silicone rubber provided on the base member through a thin adhesive-bonding layer, and the releasing layers 823 and 833 composed of PFA resin provided on the elastic layer through a thin adhesive-bonding layer, respectively. In addition, the layer 822 is composed of the same material as the layer 823, and the layer 823 is composed of the same material as the layer 833. In the example 1, the thickness of the releasing layer 823 of the heat applying roller was set at 0.04 mm, and the thickness of the releasing layer of the pressure applying roller 83 was set at 0.02 mm. In contrast with this, in the comparative example 1, the thickness of the releasing layer 823 of the heat applying roller 82 and the thickness of the releasing layer 833 of the pressure applying roller 83 were both set at 0.04 mm equally. The micro-hardness of the rollers in this condition took the values as shown in table 1 respectively.

By making the thickness of the releasing layer 833 of the pressure applying roller 83 smaller than the thickness of the releasing layer 823 of the heat applying layer 82, the surface of the releasing layer 833 of the pressure applying roller 83 became easy to comply with the surface of the transfer material carrying a toner image, and the difference in image degradation between the first side and the second side became small. It was found that the degree of compliance of the surface of the releasing layer with the surface of the transfer material carrying a toner image was reflected on the value of the micro-hardness, and by making the micro-hardness of the pressure applying roller 83 smaller than the micro-hardness of the heat applying roller 82, the difference of image degradation between the first side and the second side of the transfer material became smaller.

Further, in this structure of the heat applying roller 82 and the pressure applying roller 83, silicone rubber materials having the same hardness are used for the elastic layers respectively, and the thickness of the pressure applying roller is smaller than that of the heat applying roller; therefore, the pressure applying roller has a larger value of Asker-C hardness as a roller, and the shape of the nip when the two rollers are brought into pressing contact with each other is convex toward the direction of the heat applying roller, which makes it possible to secure the separation capability of the transfer material against the heat applying roller. In the case where a toner mainly composed of a styrene-acrylic polymer including a wax of 10% by weight or more was used, the stripping capability of a transfer material carrying a solid black image could be secured without coating the roller with a releasing agent such as a dimethyl-silicone oil.

TABLE 2

| | Outer diameter of roller product (mm) | Outer diameter of A5056 metallic core (mm) | Thickness of silicone rubber elastic layer (mm) | Hardness of rubber material (Asker-C) | Thickness of mixture layer (mm) | Material of releasing layer | Thickness of releasing layer (mm) | Micro-hardness of roller | Micro-hardness of roller when only silicone rubber is coated |
|---|---|---|---|---|---|---|---|---|---|
| Example 2 | | | | | | | | | |
| Heat applying roller | 50 | 46 | 2 | 30 | 0.03 | PFA | 0.04 | 80 | 20 |
| Pressure applying roller | 50 | 48 | 1 | 30 | 0.03 | PFA | 0.02 | 68 | 20 |
| Comparative example 2 | | | | | | | | | |
| Heat applying roller | 50 | 46 | 2 | 30 | 0.03 | PFA | 0.04 | 80 | 20 |
| Pressure applying | 50 | 48 | 1 | 30 | 0.03 | PFA | 0.04 | 80 | 20 |

TABLE 2-continued

| | Outer diameter of roller product (mm) | Outer diameter of A5056 metallic core (mm) | Thickness of silicone rubber elastic layer (mm) | Hardness of rubber material (Asker-C) | Thickness of mixture layer (mm) | Material of releasing layer | Thickness of releasing layer (mm) | Micro-hardness of roller | Micro-hardness of roller when only silicone rubber is coated |
|---|---|---|---|---|---|---|---|---|---|
| roller | | | | | | | | | |

All of silicone rubber material, releasing layer material and mixture layer material are the same, respectively As shown in FIG. 3, the heat applying roller 82 and the pressure applying roller 83, which are shown in the example 2 and comparative example 2 in Table 2, have the four-layer structures respectively formed of the thermally conductive base members 821 and 831, and the elastic layers 822 and 833 composed of a silicone rubber and the mixture layers 824 and 834 successively provided on the former ones through a thin adhesive-bonding layer, and further, the resin layers (releasing layers) 825 and 835 composed of a PFA resin provided on the mixture layer respectively. In addition, one of each of the pairs of the layers 822 and 823, 824 and 834, and 825 and 835 is composed of completely the same material as the other. The micro-hardness of the rollers in this condition took the values as shown in table 2 respectively.

In the example 2 in Table 2, the thickness of the releasing layer 823 of the heat applying roller 82 shown in FIG. 3 was set at 0.04 mm, and the thickness of the releasing layer 823 of the pressure applying roller 83 was set at 0.02 mm (corresponding to structure 4). In contrast with this, in the comparative example 2, the thickness of the releasing layer 823 of the heat applying roller 82 and the thickness of the releasing layer 833 of the pressure applying roller 83 were both set at 0.04 mm equally.

By making the thickness of the releasing layer 833 of the pressure applying roller 83 smaller than the thickness of the releasing layer 823 of the heat applying layer 82, the surface of the releasing layer 833 lying on the surface of the pressure applying roller 83 became easy to comply with the surface of the transfer material carrying a toner image, and the difference in image degradation between the first side and the second side became small. It was found that, also in the case where the rollers having the four-layer structure are used, the degree of the compliance of the surface of the releasing layer with the roughness of the surface of the transfer material carrying a toner image was reflected on the value of the micro-hardness, and by making the micro-hardness of the pressure applying roller 83 smaller than the micro-hardness of the heat applying roller 82, the difference of image degradation between the first side and the second side became small.

Further, in this structure of the heat applying roller 82 and the pressure applying roller 83, silicone rubber materials having the same hardness are used for the elastic layers respectively, and the thickness of the pressure applying roller is made smaller than that of the heat applying roller; therefore, the pressure applying roller has a larger value of Asker-C hardness as a roller, and the shape of the nip when the two rollers are brought into pressing contact with each other is convex toward the direction of the heat applying roller, which makes is possible to secure the separation capability of the transfer material against the heat applying roller. In the case where a toner mainly composed of a styrene-acrylic polymer including a wax of 10% by weight or more was used, the stripping capability of a transfer material carrying a solid black image could be secured without coating the roller with a releasing agent such as a dimethyl-silicone oil.

TABLE 3

| | Outer diameter of roller product (mm) | Outer diameter of A5056 metallic core (mm) | Thickness of silicone rubber elastic layer (mm) | Hardness of rubber material (Asker-C) | Thickness of mixture layer (mm) | Material of releasing layer | Thickness of releasing layer (mm) | Hardness of releasing layer (Shore D) | Micro-hardness of roller |
|---|---|---|---|---|---|---|---|---|---|
| Example 3 | | | | | | | | | |
| Heat applying roller | 50 | 46 | 2 | 30 | 0.03 | PFA1 | 0.03 | 60 | 75 |
| Pressure applying roller | 50 | 48 | 1 | 30 | 0.03 | PFA2 | 0.03 | 55 or less | 68 |
| Comparative example 3 | | | | | | | | | |
| Heat applying roller | 50 | 46 | 2 | 30 | 0.03 | PFA1 | 0.03 | 60 | 75 |
| Pressure applying roller | 50 | 48 | 1 | 30 | 0.03 | PFA1 | 0.03 | 60 | 75 |

All of silicone material and mixture layer material are the same, respectively. PFA2 is a material by which hardness is lowered is filled up in PFA1.

In the example 3 in Table 3, the Shore-D hardness of the releasing layer 825 of the heat applying roller 82 having the four-layer structure was set at 60, and on the other hand, the materials of the releasing layers 825 and the 835 were varied in order that the Shore-D hardness of the releasing layer 835 of the pressure applying layer 83 might have a value of 55 or smaller, which is smaller than the Shore-D hardness 60 of the releasing layer 825 of the heat applying roller 82. The other points of the structure were quite the same for both except the thickness of the silicone rubber layer. In contrast with this, in the comparative example 3, the Shore-D hardness of the releasing layer of the heat applying roller 82 and the Shore-D hardness of the releasing layer of the pressure applying roller 83 were both set at 60 equally. By the setting of Shore-D hardness as this example, the releasing layer 835 on the surface of the pressure applying roller 83 became easy to comply with the surface of the transfer material carrying a toner image, and the difference in image degradation between the first side and the second side became small. It was found that the degree of the compliance of the surface of the releasing layer with the roughness of the surface of the transfer material carrying a toner image was reflected on the value of the micro-hardness, and by making the micro-hardness of the pressure applying roller 83 smaller than the micro-hardness of the heat applying roller 82, the difference of image degradation between the first side and the second side became small.

Further, in this structure of the heat applying roller 82 and the pressure applying roller 83, silicone rubber materials having the same hardness are used for the elastic layers respectively, and the thickness of the pressure applying roller is made smaller than that of the heat applying roller; therefore, the pressure applying roller has a larger value of Asker-C hardness as a roller, and the shape of the nip when the two rollers are brought into pressing contact with each other is convex toward the direction of the heat applying roller, which makes it possible to secure the separation capability of the transfer material against the heat applying roller. In the case where a toner mainly composed of a styrene-acrylic polymer including a wax of 10% by weight or more was used, the stripping capability of a transfer material carrying a solid black image could be secured without coating the roller with a releasing agent such as a dimethyl-silicone oil.

TABLE 4

| | Outer diameter of roller product (mm) | Outer diameter of A5056 metallic core (mm) | Thickness of silicone rubber elastic layer (mm) | Hardness of rubber material (Asker-C) | Thickness of mixture layer (mm) | Material of releasing layer | Thickness of releasing layer (mm) | Micro-hardness of roller |
|---|---|---|---|---|---|---|---|---|
| Example 4 | | | | | | | | |
| Heat applying roller | 50 | 46 | 2 | 30 | 0.04 | PFA | 0.02 | 72 |
| Pressure applying roller | 50 | 48 | 1 | 30 | 0.02 | PFA | 0.02 | 65 |
| Comparative example 4 | | | | | | | | |
| Heat applying roller | 50 | 46 | 2 | 30 | 0.04 | PFA | 0.02 | 72 |
| Pressure applying roller | 50 | 48 | 1 | 30 | 0.04 | PFA | 0.02 | 72 |

All of silicone material, releasing layer material and mixture layer material are the same, respectively.

In the example 4 in Table 4, the releasing layer 825 of the heat applying roller 82 composed of four layers and the releasing layer 835 of the pressure applying roller 83, both rollers having the four-layer structure, were both formed of the same material perfluoro-ethylene (PFA) to have the same thickness 0.02 mm; further, the thickness of the mixture layer 824 of the heat applying roller 82 was set at 0.04 mm and the thickness of the mixture layer 834 of the pressure applying roller 83 was set at 0.02 mm, that is, the thickness of the mixture layer 834 was made smaller than the thickness of the mixture layer 824. In contrast with this, in the comparative example 4, the thickness of the mixture layer 824 was made equal to the thickness of the mixture layer 834.

By this setting of the thickness values of the mixture layer 824 and the mixture layer 834, the releasing layer 833 lying on the surface of the pressure applying roller 83 became easy to comply with the surface of the transfer material carrying a toner image, and the difference in image degradation between the first side and the second side became small. It was found that the degree of the compliance of the surface of the releasing layer with the roughness of the surface of the transfer material carrying a toner image was reflected on the value of the micro-hardness, and by making the micro-hardness of the pressure applying roller 83 smaller than the micro-hardness of the heat applying roller 82, the difference of image degradation between the first side and the second side became small.

Further, in this structure of the heat applying roller 82 and the pressure applying roller 83, silicone rubber materials having the same hardness are used for the elastic layers respectively, and the thickness of the pressure applying roller is made smaller than that of the heat applying roller; therefore, the pressure applying roller has a larger value of Asker-C hardness as a roller, and the shape of the nip when the two rollers are brought into pressing contact with each other is convex toward the direction of the heat applying roller, which makes it possible to secure the separation capability of the transfer material against the heat applying roller. In the case where a toner mainly composed of a styrene-acrylic polymer including a wax of 10% by weight or more was used, the stripping capability of a transfer material carrying a solid black image could be secured without coating the roller with a releasing agent such as a dimethyl-silicone oil.

TABLE 5

| | Outer diameter of roller product (mm) | Outer diameter of A5056 metallic core (mm) | Thickness of silicone rubber elastic layer (mm) | Hardness of rubber material (Asker-C) | Thickness of mixture layer (mm) | Material of mixture layer | Hardness of mixture layer (JIS-A) | Material of releasing layer | Thickness of releasing layer (mm) | Micro-hardness of roller |
|---|---|---|---|---|---|---|---|---|---|---|
| Example 5 | | | | | | | | | | |
| Heat applying roller | 50 | 46 | 2 | 30 | 0.03 | (1) | 90° or more | PFA | 0.03 | 75 |
| Pressure applying roller | 50 | 48 | 1 | 30 | 0.03 | (2) | 80° or more | PFA | 0.03 | 70 |
| Comparative example 5 | | | | | | | | | | |
| Heat applying roller | 50 | 46 | 2 | 30 | 0.03 | (1) | 90° or more | PFA | 0.03 | 75 |
| Pressure applying roller | 50 | 48 | 1 | 30 | 0.03 | (1) | 90° or more | PFA | 0.03 | 75 |

All of silicone material and releasing layer material are the same, respectively. Mixture layer (2) is a material in which weight percent of fluorine-contained resin PFA in mixture layer (1) is reduced.

In the example 5 in Table 5, the releasing layer 825 of the heat applying roller 82 and the releasing layer 835 of the pressure applying roller 83, both rollers having the four-layer structure, were both formed of the same material perfluoro-ethylene (PFA) to have the same thickness 0.02 mm; further, the mixture layer 824 of the heat applying roller 82 was formed to have the hardness 90° or over of JIS-A and the mixture layer 834 of the pressure applying roller 83 was formed to have the hardness 80° or over of JIS-A. In contrast with this, in the comparative example 6, the hardness of the mixture layer 824 was made equal to the hardness of the mixture layer 834.

By making the hardness of the mixture layer 834 of the pressure applying roller 83 smaller than the hardness of the mixture layer 824 of the heat applying layer 82, the releasing layer 833 lying on the surface of the pressure applying roller 83 became easy to comply with the surface of the transfer material carrying a toner image, and the difference in image degradation between the first side and the second side became small. It was found that the degree of the compliance of the surface of the releasing layer with the roughness of the surface of the transfer material carrying a toner image was reflected on the value of the micro-hardness, and by making the micro-hardness of the pressure applying roller 83 smaller than the micro-hardness of the heat applying roller 82, the difference of image degradation between the first side and the second side became small.

Further, in this structure of the heat applying roller 82 and the pressure applying roller 83, silicone rubber materials having the same hardness are used for the elastic layers respectively, and the thickness of the pressure applying roller is made smaller than that of the heat applying roller; therefore, the pressure applying roller has a larger value of Asker-C hardness as a roller, and the shape of the nip when the two rollers are brought into pressing contact with each other is convex toward the direction of the heat applying roller, which makes it possible to secure the separation capability of the transfer material against the heat applying roller. In the case where a toner mainly composed of a styrene-acrylic polymer including a wax of 10% by weight or more was used, the stripping capability of a transfer material carrying a solid black image could be secured without coating the roller with a releasing agent such as a dimethyl-silicone oil.

(Another Embodiment of an Image Forming Apparatus)

In the examples 1 to 5, the examples are shown in which the separation capability is secured by making the silicone rubber material in the heat applying roller 82 and that in the pressure applying roller completely the same, and making the thickness of the silicone rubber layer of the pressure applying roller 83 smaller than the thickness of the silicone rubber layer of the heat applying roller 82, which makes the shape of the nip convex toward the direction of the heat applying roller; however, the separation capability can be also secured, for example, by making the thickness of the silicone rubber layer of the heat applying roller 82 equal to that of the pressure applying roller 83, and making the hardness of the silicone rubber material of the pressure applying roller 83 larger than the hardness of the silicone rubber material of the heat applying roller 82. In such a case as shown in FIG. 4, the separation capability can be secured by making the Asker-C hardness of the upper pressure applying roller 91A smaller than the Asker-C hardness of the lower pressure applying roller 91B, which makes the shape of the nip convex toward the direction of the upper pressure applying roller (heat applying fixing belt).

In the case where the thickness of the elastic layer of the heat applying roller (heat applying fixing belt) and that of the pressure applying roller are about 1 mm or over, and the hardness of the silicone rubber material of the heat applying roller (heat applying fixing belt) is equal to or larger than the hardness of the silicone rubber material of the pressure applying roller (in the case where, in respect of the micro-hardness before providing the surface layer, the micro-hardness of the pressure applying roller is equal to or larger than the micro-hardness of the heat applying roller), if the relation described in structure 1 is established, it can be said that the pressure applying roller has a larger compliance with the surface roughness. However, in the case where the thickness of the elastic layer of the heat applying roller (heat applying fixing belt) is different from that of the pressure applying roller, and the thickness of at least one of them is as thin as several hundreds μm or under, or in the case where the material of the elastic layer of the heat applying roller (heat applying fixing belt) is different from that of the pressure applying roller, from the micro-hardness of the roller or the belt itself only, it cannot be judged that the pressure applying roller has a larger compliance with the surface roughness. In this case, it is appropriate to compare the micro-hardness in the case where the heat applying roller and the pressure applying roller are formed with their elastic layer made of the same material, to have the same thickness.

A color image forming apparatus of this invention is not to be limited to the color image forming apparatus of a tandem type shown in FIG. 1, but this invention can be applied to a color image forming apparatus of such a type that a plurality of toner images t formed on a plurality of image carrying members respectively are directly transferred on a paper sheet P to form superposed toner images t, which are then fixed by a fixing device.

Further, this invention can be applied to a color image forming apparatus of such a type that color toner images t, which have been successively formed on an image carrying member in such a way that later ones are superposed on the former ones, are transferred onto a paper sheet P all at a time at a transfer zone to form a composite color image, and after that, the paper sheet P is picked off from the surface of the image carrying member, to fix the superposed toner images t by a fixing device. Besides, this invention can be applied to a monochromatic image forming apparatus.

Further, this invention can be applied to a fixing device in the case where the structure of the heat applying roller 82 or the pressure applying roller 83 are composed of multiple layers not less than five layers which are, for example, a metallic core, a silicone rubber layer, a fluorine-contained rubber layer, a mixture layer, and a fluorine-contained resin layer. Moreover, also in the case where the heat applying roller has a different layer structure from the pressure applying roller, by making the structure such one as shown in structure 2 or 3, the image quality degradation of the first side can be suppressed.

In respect of image degradation produced in the fixing process, the softer the surface layer to be brought in contact with an undeveloped image surface is, the easier the surface layer is to comply with the roughness of a transfer material, the presence or absence of toner particles, and the thickness of the toner layer, which reduces the image degradation such as unevenness of toner fusing. Therefore, by employing any one of the structures described in structures 1 to 7, which causes the surface of the releasing layer lying on the surface of the pressure applying roller to comply with the surface of a transfer material carrying a toner image more easily than the releasing layer lying on the surface of the heat applying roller, the image degradation caused by it that the first side of a transfer material is brought into contact with the heat applying roller and the pressure applying roller once for each can be suppressed to a degree not so remarkable as compared with the degradation of the toner image on the second side of the transfer material.

Further, by employing any one of the conditions described in structures 9 to 11, and 14, the shape of the fixing nip portion in the case where the fixing device is seen from the lateral side becomes convex-shaped toward the direction of the heat applying roller 82, which makes it possible to enhance the separation capability of the transfer material against the heat applying roller; thus, the detaching capability, the gloss of images, and the level of the image degradation can be stabilized. In particular, in a color image forming apparatus, a high image quality can be obtained.

Further, by employing the condition described in structure 16, suppression of the image degradation of the first side and high separation capability can be secured without an oil coating mechanism being provided in the fixing device.

What is claimed is:

1. A fixing device for use in an image forming apparatus which is capable of forming both-side images on a sheet which passes through the fixing device twice by using a sheet reversing and conveying device, the fixing device comprising:

(a) a heat applying rotary body having an elastic layer made of rubber including at least one layer and further a toner releasing layer on top thereof for coming into contact with and heating a side bearing an unfixed toner image of a transfer sheet;

(b) a pressure applying rotary body having a second elastic layer made of rubber including at least one layer and further a second toner releasing layer on top thereof for fixing and conveying the transfer material by coming into pressure contact and rotating with the heat applying rotary body; and (c) a heat applying source for heating at least one of said rotary bodies, wherein micro-hardness of the pressure applying rotary body is smaller than that of the heat applying rotary body.

2. The fixing device of claim 1, wherein the micro-hardness of the pressure applying rotary body before providing the second releasing layer is equal to or larger than that of the heat applying rotary body before providing the releasing layer.

3. The fixing device of claim 1, wherein each value of the micro-hardness of the pressure applying rotary body and the heat applying rotary body represents each value when the elastic layer of the heat applying rotary body and the second elastic layer of the pressure applying rotary body are formed of a same material in a same thickness.

4. The fixing device of claim 1, wherein the releasing layer of the heat applying rotary body and the second releasing layer of the pressure applying rotary body are formed of a same material, and a thickness of the second releasing layer of the pressure applying rotary body is smaller than that of the releasing layer of the heat applying rotary body.

5. The fixing device of claim 1, wherein hardness of the second releasing layer of the pressure applying rotary body is smaller than that of the releasing layer of the heat applying rotary body.

6. The fixing device of claim 1, wherein the heat applying rotary body further comprises a mixture layer composed of a rubber and a resin, which is provided between the elastic layer and the releasing layer, and the pressure applying rotary body further comprises a second mixture layer composed of a rubber including at least one layer and resin, which is provided between the second elastic layer and second releasing layer, and wherein when the releasing layer of the heat applying rotary body and the second releasing layer of the pressure applying rotary body are formed of a same material in a same thickness, a thickness of the second mixture layer of the pressure applying rotary body is smaller than that of the mixture layer of the heat applying rotary body.

7. The fixing device of claim 1, wherein the heat applying rotary body further comprises a mixture layer composed of a rubber and a resin, which is provided between the elastic layer and the releasing layer, and the pressure applying rotary body further comprises a second mixture layer composed of a rubber including at least one layer and resin, which is provided between the second elastic layer and second releasing layer, and wherein when the releasing layer of the heat applying rotary body and the second releasing layer of the pressure applying rotary body are formed of a same material in a same thickness, hardness of the second mixture layer of the pressure applying rotary body is smaller than that of the mixture layer of the heat applying rotary body.

8. The fixing device of claim 1, wherein the heat applying rotary body represents a roll shape and has a stiffness body inside the elastic layer and the pressure applying rotary body represents a roll shape and has a stiffness body inside the second elastic layer.

9. The fixing device of claim 8, wherein Asker-C hardness of the pressure applying rotary body is larger than that of the heat applying rotary body.

10. The fixing device of claim 8, wherein the elastic layer of the heat applying rotary body and the second elastic layer of the pressure applying rotary body are formed so that Asker-C hardness per unit thickness of the elastic layers is equal to each other, and a thickness of the elastic layer of the heat applying rotary body is made larger than that of the second elastic layer of the pressure applying rotary body.

11. The fixing device of claim 8, wherein a thickness of the second elastic layer of the pressure applying rotary body is equal to that of the elastic layer of the heat applying rotary body, and Asker-C hardness of the releasing layer of the heat applying rotary body is smaller than that of the second releasing layer of the pressure applying rotary body.

12. The fixing device of claim 1, wherein the heat applying rotary body is a heat applying and fixing belt representing an endless belt shape, and the pressure applying rotary body represents a roll shape and has a stiffness body inside the second elastic layer.

13. The fixing device of claim 12, further comprising a pressure applying body for coming into contact with an inner side of the heat applying and fixing belt and for pressing the heat applying and fixing belt toward the pressure applying rotary body.

14. The fixing device of claim 13, wherein Asker-C hardness of the pressure applying rotary body is larger than that of the pressure applying body.

15. An image forming apparatus comprising the fixing device set forth in claim 1, and an image forming device capable of outputting an image having at least two or more colors.

16. An image forming apparatus comprising the fixing device set forth in claim 1, wherein an outer layer of each of the heat applying rotary body and the pressure applying rotary body mainly comprises PFA, a toner comprises a wax, and a mechanism for coating the toner releasing layer to a surface of each of the heat applying rotary body and the pressure applying rotary body is absent.

* * * * *